US009080331B2

(12) United States Patent
Aboukhalil

(10) Patent No.: US 9,080,331 B2
(45) Date of Patent: Jul. 14, 2015

(54) UNIVERSAL ARCHITECTURAL SYSTEM

(76) Inventor: Charbel Tannious Aboukhalil, Grand Terrace, CA (US)

( * ) Notice: Subject to any disclaimer, the term of this patent is extended or adjusted under 35 U.S.C. 154(b) by 0 days.

(21) Appl. No.: 13/149,125

(22) Filed: May 31, 2011

(65) Prior Publication Data

US 2012/0304573 A1 Dec. 6, 2012

(51) Int. Cl.
*E04F 13/08* (2006.01)
*E04F 19/06* (2006.01)

(52) U.S. Cl.
CPC ..... *E04F 13/083* (2013.01); *E04F 13/0816* (2013.01); *E04F 19/061* (2013.01); *E04F 19/062* (2013.01); *E04F 19/064* (2013.01)

(58) Field of Classification Search
CPC . E04F 13/081; E04F 13/0819; E04F 13/0821; E04F 13/083; E04F 19/06; E04F 19/062; E04F 13/0826; E04F 13/0816; E04B 1/7629; E04B 2/88
USPC ..... 52/506.05, 506.06, 507, 509–512, 235, 52/238.1, 239, 241–243, 514, 716.8, 52/718.04
See application file for complete search history.

(56) References Cited

U.S. PATENT DOCUMENTS 3,173,178 A * 3/1965 Kumburis ..... 52/508
4,452,029 A * 6/1984 Sukolics ..... 52/747.1
4,483,122 A * 11/1984 Crandell ..... 52/747.1
4,829,740 A * 5/1989 Hutchison ..... 52/475.1
4,866,896 A * 9/1989 Shreiner et al. ..... 52/235
5,918,437 A * 7/1999 Dobija ..... 52/506.01
6,035,598 A * 3/2000 Sukolics et al. ..... 52/506.08
6,202,377 B1 * 3/2001 Krieger ..... 52/489.1
6,226,947 B1 * 5/2001 Bado et al. ..... 52/483.1
6,484,465 B2 * 11/2002 Higgins ..... 52/474
6,631,589 B1 * 10/2003 Friedman et al. ..... 52/30
6,748,709 B1 * 6/2004 Sherman et al. ..... 52/235
7,562,504 B2 * 7/2009 Herbst et al. ..... 52/461
7,621,084 B2 * 11/2009 Bilge ..... 52/235
7,810,289 B2 * 10/2010 Montgomery ..... 52/235
8,127,507 B1 * 3/2012 Bilge ..... 52/235
8,166,716 B2 * 5/2012 Macdonald et al. ..... 52/235
8,240,099 B2 * 8/2012 Hummel, III ..... 52/506.05
8,347,577 B2 * 1/2013 Aboukhalil ..... 52/489.1
2006/0070329 A1 * 4/2006 Schiltz ..... 52/506.01
2006/0080939 A1 * 4/2006 Bledsoe et al. ..... 52/750
2007/0022682 A1 * 2/2007 Morgenegg et al. ..... 52/235
2007/0119105 A1 * 5/2007 MacDonald et al. ..... 52/235
2009/0241444 A1 * 10/2009 Griffiths ..... 52/235
2009/0313928 A1 * 12/2009 Montgomery ..... 52/309.1
2009/0313935 A1 * 12/2009 Montgomery ..... 52/506.1
2012/0017530 A1 * 1/2012 Hummel, III ..... 52/506.05

* cited by examiner

*Primary Examiner* — Elizabeth A Plummer
(74) *Attorney, Agent, or Firm* — Stetina Brunda Garred & Brucker

(57) ABSTRACT

A wall panel system may comprise a plurality of panels which may be mounted to a wall. The panels have panel clips attached to the backside thereof. The wall has a plurality of horizontal joints attached thereto. The panel clips and the horizontal joints have tongues and grooves which allow the panel to be mounted to the wall. Preferably, the tongues are formed on the panel clips and point in the same direction. The grooves are formed on the horizontal joints and point in the opposite direction from the tongues. In this manner, the tongues can be inserted or hung into the grooves. The panels are locked in place by a plurality of horizontal caps which engage the horizontal joints and prevent the panel immediately below the horizontal caps from being removed.

15 Claims, 10 Drawing Sheets

UNIVERSAL ARCHITECTURAL SYSTEM

CROSS-REFERENCE TO RELATED APPLICATIONS

Not Applicable

STATEMENT RE: FEDERALLY SPONSORED RESEARCH/DEVELOPMENT

Not Applicable

BACKGROUND

The embodiments disclosed herein are directed to a wall panel system that is mounted to a wall or ceiling.

Prior art wall panel systems comprise a plurality of panels which are mounted to the wall row by row. The bottom most row of panels is initially mounted to the wall. Thereafter, a horizontal runner locks the first row of panels in place so that the first row of panels cannot be removed from the wall. A second row of panels is stacked on the first row of panels and locked in by a second runner. This process is repeated until the desired height is achieved. Unfortunately, when a panel in the first row of panels is damaged, all of the upper rows of panels must be removed in order to reach the damaged panel for removal and replacement. This process is time consuming and expensive. Accordingly, there is a need in the art for an improved wall panel system.

BRIEF SUMMARY

The embodiments describe herein address the needs discussed above, discussed below and those that are known in the art.

The universal architectural system comprises a plurality of panels which are arranged in a series of stacked rows of panels. Each of the panels in the rows of panels may be aligned vertically to the panels immediately above and/or immediately below the panel. Each of the panels are attached to a wall with a tongue and groove connection. Preferably, a plurality of horizontal joints are attached to the wall which has a plurality of upwardly directed grooves. Each of the panels has a panel clip on the upper side and the lower side of the panel. The upper and lower panel clips have downwardly directed tongues which engage upwardly directed grooves of the horizontal joints. To mount the panels to the wall, the tongues of the panel clips are inserted into the grooves of the horizontal joints. Gravity keeps the tongues in the grooves. To lock the panels in place, horizontal joint caps are attached to the horizontal joints and disposed above each of the panels. The horizontal joint caps prevent the panels from being lifted up and off of the wall. To replace a damaged panel, the horizontal joint cap above the damaged panel is removed. The damaged panel is removed from the wall and replaced with a new panel. In certain embodiments, edge caps are removed from the row of panels in which the damaged panel is located. This allows panels laterally adjacent to the damaged panel to be shifted left and right so that vertical splines can be removed from the damaged panel. After removal of the damaged panel, the vertical splines are reengaged to the new replacement panel. The wall panel system is reassembled in reverse order. Accordingly, the wall panel system or the universal architectural system described herein provides for easy removal and replacement of the damaged panel without having to remove all of the panels.

More particularly, a wall panel system installed on a first wall or ceiling is disclosed. The system may comprise a plurality of panel, a plurality of clips and a plurality of elongate joints. The plurality of panels may be arranged in a plurality of rows within a common plane (e.g., vertical or horizontal). Each panel may define opposed first and second edges and a back surface. The first edges of a first row of panels may be disposed immediately adjacent to the second edges of a second row of panels.

The plurality of clips may define either clip grooves or clip tongues. The clips may be attached to the back surfaces of the panels adjacent to both the first edges and the second edges. The clip grooves or clip tongues may be oriented in a first direction.

The plurality of elongate joints may be attached to the first wall for securing the plurality of panels to the first wall. A first joint of the plurality of joints may be attached on the first wall parallel and adjacent to the first edges of the first row of panels and the second edges of the second row of panels. Each of the joints have a joint tongue or a joint groove which are oriented in a second direction which is opposite the first direction for receiving either of the clip grooves or the clip tongues, respectively.

Any one of the plurality of panels is removable from the first wall independent of the remainder of the plurality of panels to provide for convenient replacement of one or more damaged panels.

The plurality of clips may define clip grooves so that the clip grooves are oriented in a downward direction when the clip grooves are attached to the back surfaces of the panels and the joints have joint tongues which are oriented in a upward direction.

Each of the panels may define opposed third and fourth edges which together with the first and second edges define the outer periphery of the panel. The third and fourth edges may have grooves. The third groove of one panel may be aligned to a fourth groove of an adjacent panel. A vertical spline may be received into the third groove of the one panel and the fourth groove of the adjacent panel. A spline cap may be attached to the vertical spline.

The system may further comprise an upper edge cap which is in contact with the upper edge of the upper most panel and attached to the elongate joint disposed adjacent to the upper edge of the upper most panel.

The system may further comprise a horizontal joint cap which is in contact with the upper edge of the panel and attached to the elongate joint disposed adjacent to the upper edge of the panel.

The clip tongue or the joint tongue discussed herein may have a tapered cross sectional configuration.

The system may further comprise a second wall connected to the first wall or the ceiling wherein the second wall and the first wall defines a vertical corner and the second wall and the ceiling defines a horizontal corner. A corner receiver may be attached to the vertical corner or the horizontal corner. The vertical corner may be an inside corner or an outside corner. A corner guard may be attached to the corner receiver with a tongue and groove connection.

Additionally, a method of changing out one panel from a plurality of panels which are mounted to a wall is disclosed. The method may comprise the steps of providing a plurality of panels mounted to the wall wherein the plurality of panels are arranged in a series of rows and columns, adjacent upper and lower panels defining a horizontal gap; a plurality of horizontal caps disposed within the horizontal gaps of adjacent upper and lower panels prevent vertical movement of the lower panel disposed beneath such horizontal cap; removing the horizontal cap above the one panel; traversing the one panel upward to release a tongue and groove connection between the panel and the wall; and pulling out the one panel from the plurality of panels.

The method may further comprises the steps of removing a vertical edge cap to allow lateral movement of panels adjacent to the one panel to be removed so that vertical splines attached to opposed lateral sides of the one panel may be removed; moving the laterally adjacent panels from the one panel away from the one panel; and removing the vertical splines from the one panel.

The method may further comprising the steps of inserting a new panel in the position of the one panel; attaching the vertical splines to new panel; moving the laterally adjacent panels of the new panel toward the new panel; reinserting the vertical edge cap; and reinserting the horizontal cap above the new panel.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
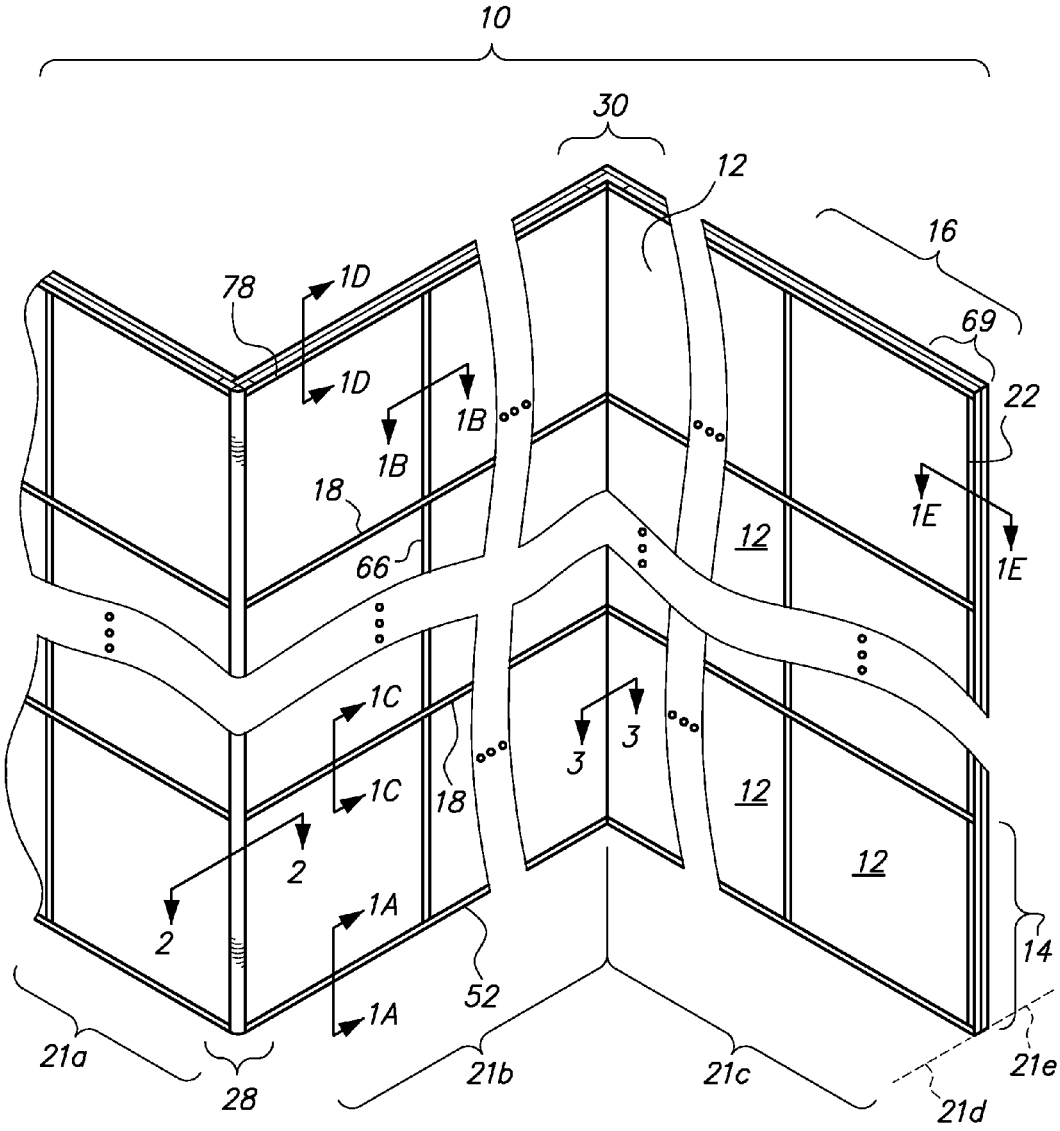
FIG. 1 is a perspective view of a plurality of walls with a wall panel system mounted thereto.

Referring now to the drawings, a wall panel system 10 is shown. The system 10 may comprise a plurality of panels 12 that may be arranged in a series of rows 14 and columns 16. After installation, when one of the panels 12 is damaged and needs to be replaced, the damaged panel can be easily removed without removing the surrounding undamaged panels 12. To do so, a horizontal joint cap 18 (see FIG. 1C) is removed from a horizontal joint receiver 20 attached to a wall 21 immediately above the damaged panel 12. This provides space above the damaged panel so that the damaged panel 12 can be lifted out. If necessary, a vertical edge cap 22 is removed from a vertical edge trim 24 (see FIG. 1E) which is attached to the wall 21 on the left or right side of the damaged panel 12. The undamaged panels 12 on the left and right side of the damaged panel 12 may be shifted to the left and right to remove vertical splines 26 (see FIG. 1B) on lateral sides of the damaged panel 12. The damaged panel 12 can now be lifted and removed. A new panel 12 may be dropped into place without removal of the panels on the left, right, above, or below the damaged panel 12. Accordingly, the wall panel system 10 disclosed herein provides for a system in which damaged panels 12 can be easily replaced. After the new panel 12 is placed in the position of the damaged panel 12, the wall system 10 is reassembled in reverse order.

More particularly, referring now to FIG. 1, a plurality of walls 21*a, b* and *c* are shown. The plurality of walls 21*a-c* illustrate an outside corner 28 between walls 21*a, b* and an inside corner 30 between walls 21*b, c*. Wall 21*c* illustrates an edge 69.

Figure 1A:
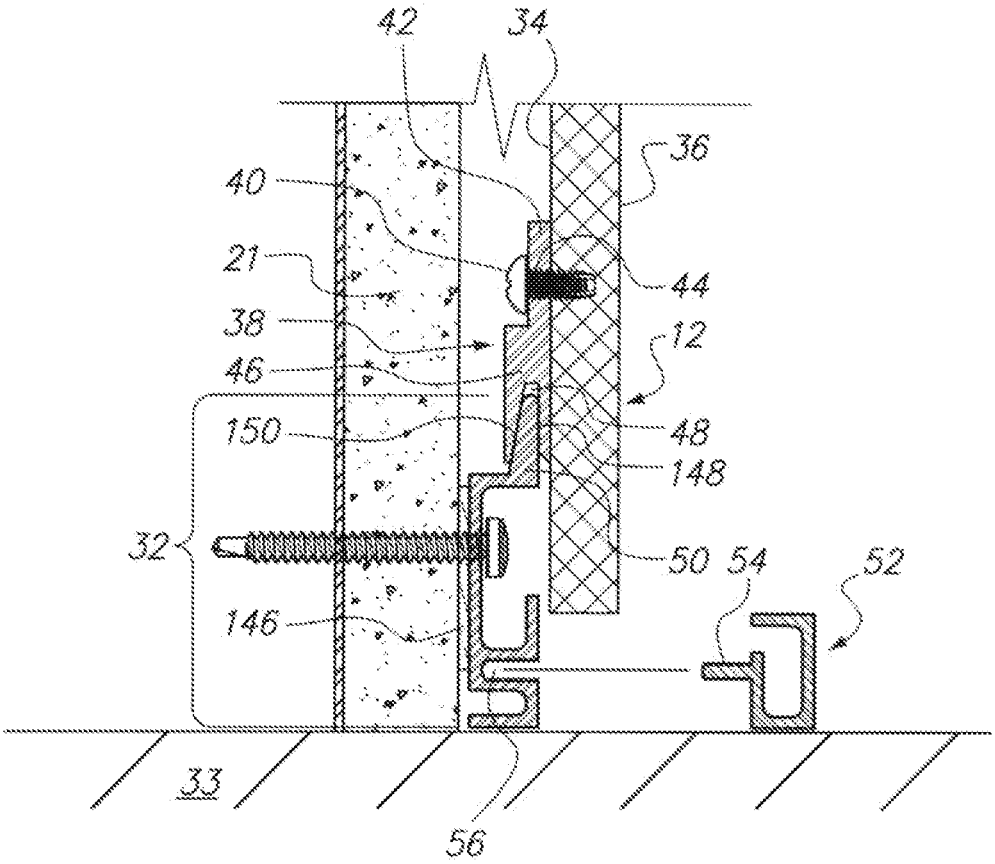
FIG. 1A is a cross-sectional view of a bottom edge of the wall panel system shown in FIG. 1.

To install the panels 12 on the wall 21, a base edge trim 32 shown in FIG. 1A is attached to the wall 21 along the bottom edge of the wall adjacent to the ground 33. The base edge trim 32 may extend horizontally along a portion or the entire length of the wall 21. Preferably, the base edge trim 32 extends along the wall 21 to the same extent as the bottom most row 14 of panels 12 to be mounted to the wall 21. For example, if three panels 12 make up a row of panels 12, then the base edge trim 32 extends along the entire length of the three panels 12. The base edge trim 32 is shown as being mounted to the wall 21 closely adjacent to or abutting the ground 33. However, it is also contemplated that the base edge trim 32 may be positioned above the ground 33 so as to reveal the underlying wall 21 and provide a gap between the lower most panel 12 and the ground 33. The base edge trim 32 may be an extruded from any generally rigid material such as aluminum and may be cut to length according to the wall panel installation at hand.

The panel 12 may have a backside 34 which is not exposed and not viewable. The panel 12 may also have a front side 36 that is exposed and viewable. The front side 36 of the panel 12 may have various aesthetic features that work alone or in combination with the aesthetic features of the other panels 12. The backside 34 of the panel 12 may have one or more horizontal panel clips 38 attached thereto with one or more screws 40. The panel clips 38 may be shorter than the width of the panel 12 or may extend across the entire width of one or more of the panel 12. Preferably, the panel clip 38 is about two to three inches long provided that the panel is about 12" wide or more. The panel clip 38 may define a base portion 42 having a hole 44 through which one or more screws secure the panel clip 38 to the backside 34 of the panel 12. The panel clip 38 may additionally have a fork portion 46. The fork portion 46 defines a groove 48. The groove 48 may have a tapered configuration which matches a tapered configuration of tongue 50 of the base edge trim 32. The taper of the tapered tongue 50 and the taper of the groove 48 may match so that the panel 12 does not have any play or travel after the panel 12 is mounted to the wall 21. The base edge cap 52 may be attached to the base edge trim 32. A base edge cap 52 may be an extruded part. The cross section is shown in FIG. 1A. It is contemplated that a length of the base edge cap 52 may be a portion or the entire width of the panel 12 or wall 21. To attach the base edge cap 52 to the base edge trim 32, the base edge cap 52 has a ribbed protrusion 54 which is received into a ribbed groove 56 of the base edge trim 32. Silicone may be disposed into the ribbed groove 56. The ribbed protrusion 54 is inserted into the ribbed groove 56. The ribbed protrusion 54 is sized to be smaller than the ribbed groove 56 so that the ribbed protrusion 54 can be easily inserted into the ribbed groove 56. After inserting the ribbed protrusion 54 into the ribbed groove 56 with silicone, the silicone flows between the ribs of the protrusion 54 and the groove 56. After the silicone cures, the silicone latches onto the ribs of the protrusion 54 and groove 56 to prevent unintended pullout of the base edge cap 52.

Figure 1B:
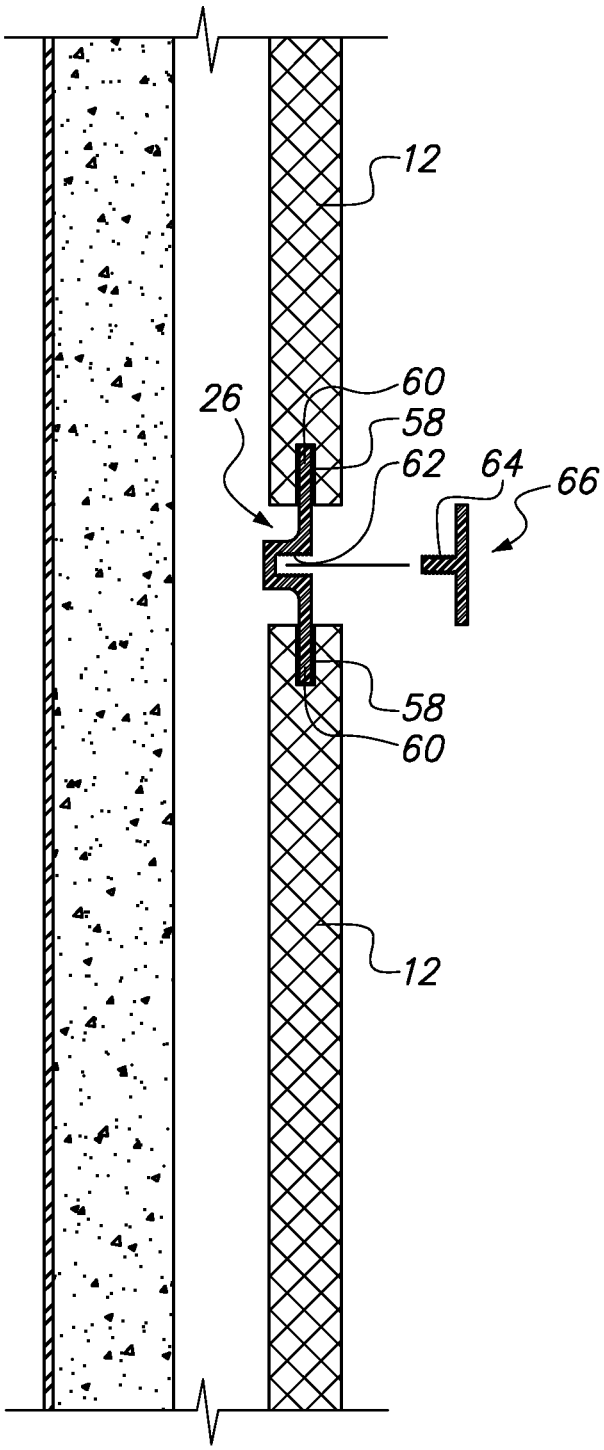
FIG. 1B is a cross-sectional view of a vertical joint of the wall panel system shown in FIG. 1.
Figure 1C:
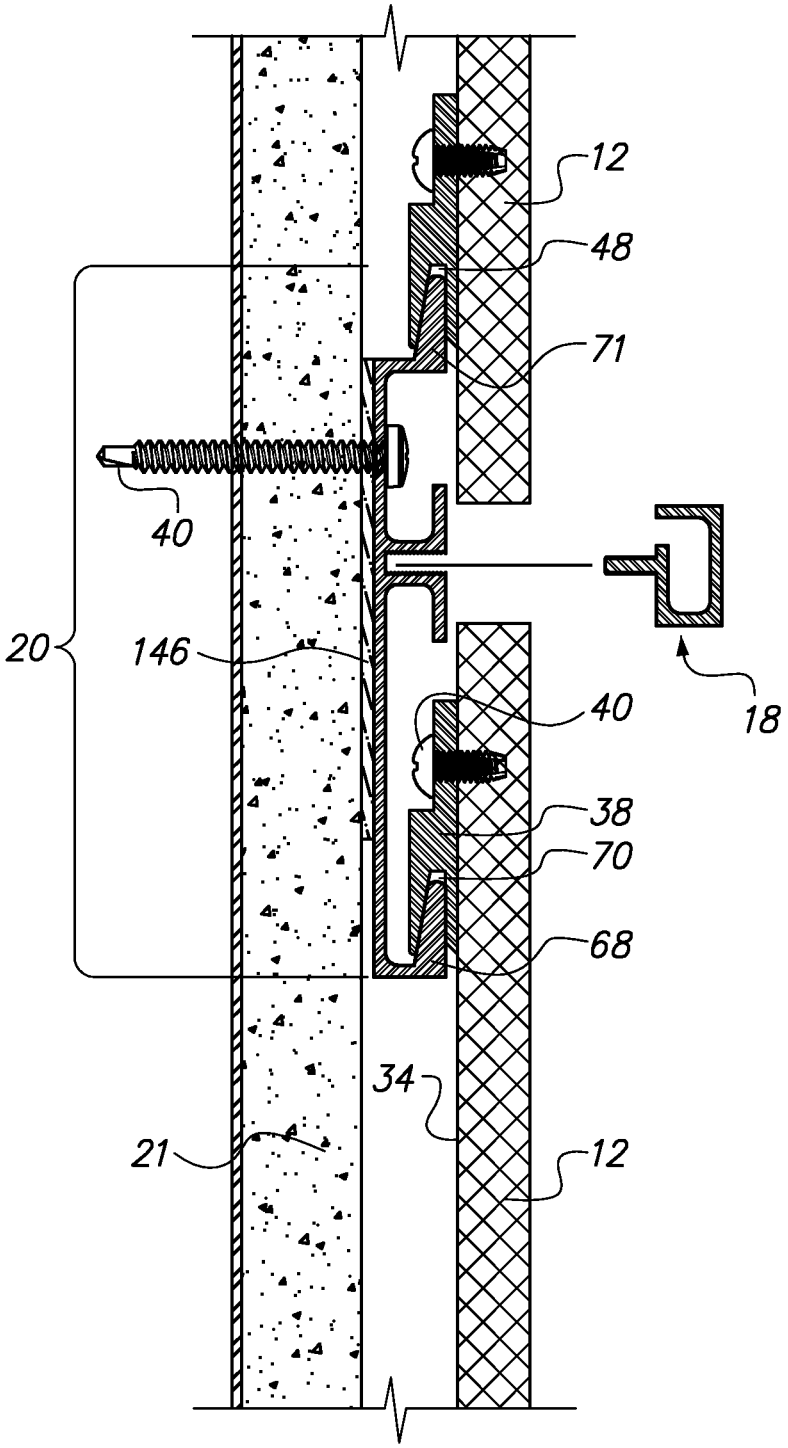
FIG. 1C is a cross-sectional view of a horizontal joint shown in FIG. 1.

Left and right edges of the panel 12 may have grooves 58 (see FIG. 1B). Grooves 58 of adjacent panels 12 receive a vertical spline 26 which may regulate the lateral spacing between adjacent panels 12. The vertical spline 26 may have tongues 60 which are received into the grooves 58. The vertical spline 26 may have a ribbed groove 62 which is oriented perpendicular to the tongues 60. The grooves 62 may receive a ribbed protrusion 64 of a vertical joint cap 66. The vertical spline 26 and the vertical joint cap 66 may be an extruded part that runs a portion of or the entire height of the panel 12 as shown in FIG. 1. The opposed ends of the vertical joint caps 66 may abut up against the base edge cap 52 that runs horizontally between each row 14 of panels 12.

A first row of panels 12 is mounted to the wall 21. The left and right most panels may terminate at an outside corner 28, an inside corner 30 or an edge 69. The edge 69 may be located midway on the wall 21 or at an inturned wall 21*d* or at an out turned wall 21*e*. In this instance, the panels 12 do not extend on to the in turned or out turned walls 21*d* or *e* (see FIG. 1).

The upper horizontal edge of the panel 12 may be mounted to the wall 21 by a similar tongue and groove system shown in FIG. 1A. In particular, referring to FIG. 1C, a horizontal joint receiver 20 may be attached to the wall 21 with one or more screws 40. The joint receiver 20 preferably extends the entire length of the row of panels 12. The horizontal joint receiver 20 has a lower tongue 68. The backside 34 of the panel 12 may have a panel clip 38 attached thereto with one or more screws 40. The clip 38 has a groove 70 which receives the tongue 68. The groove 70 and tongue 68 may have a matching tapered configuration so that the panel 12 does not wobble when the tongue 68 is received into the groove 70. When the panel 12 is mounted to the wall 21, the tongues 50, 68 (see FIGS. 1A and 1C) are received into the grooves 48, 70 simultaneously. The tongues 50, 68 sit in the grooves 48, 70 simultaneously so that there is no play or wobble. The panel 12 is hung on the wall 21 by way of the tongue and groove configuration which point the same way so that the panel 12 can be conveniently lifted off the wall 21. The horizontal joint receiver 20 additionally has an upper tongue 71 which is received into groove 48 located on the bottom edge of the next upper panel 12. The horizontal joint receiver 20 provides a preset gap between the upper and lower panels 12 by predefining the distance between the upper and lower tongues 71, 68. The horizontal joint receiver 20 may extend across the entire desired width of the wall 21 or row of panels 12. Additional horizontal joint receivers 20 and panels 12 may be vertically attached to the wall 21 to stack additional rows 14 of panels 12 on the wall 21 until the desired height is achieved.

Figure 1D:
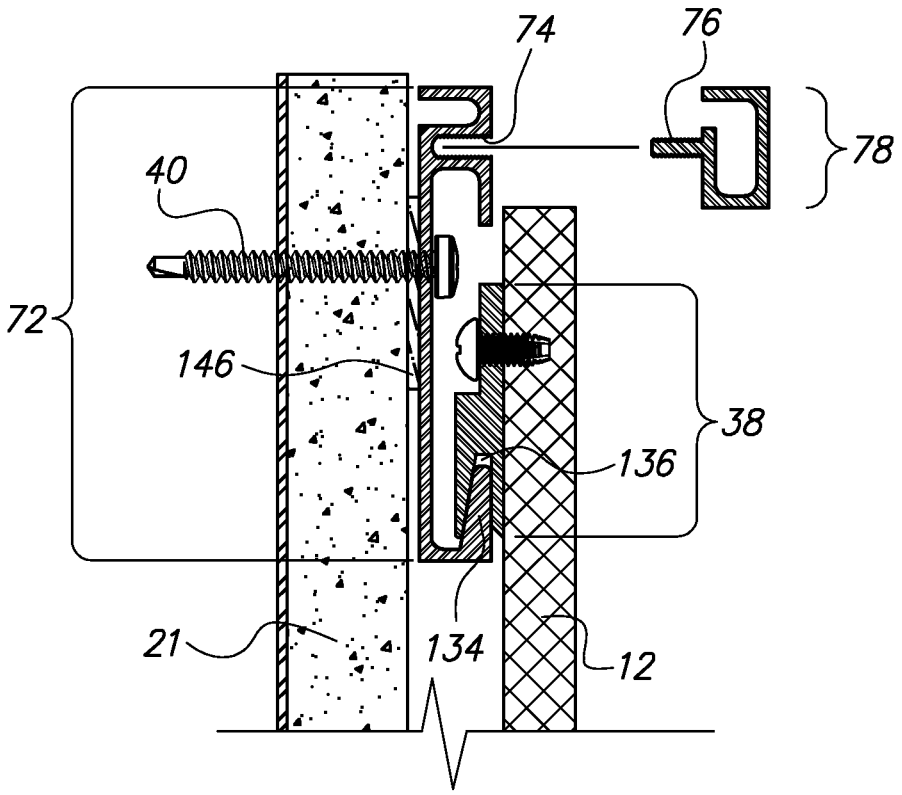
FIG. 1D is a cross-sectional view of a top edge of the wall panel system shown in FIG. 1.

Referring to FIG. 1D, when the upper most row 14 of panels 12 is installed, the upper edge of the upper most panel 12 may be secured to the wall 21 by way of an upper edge trim 72. The upper edge trim 72 is attached to the wall 21 with one or more screw 40. Horizontal panel clip 38 is attached to the upper portion of the panel 12. The upper edge trim 72 has a tongue 134 which is received into a groove 136 of the horizontal panel clip 38. The upper edge trim 72 also has a ribbed slot 74 which is received by a ribbed protrusion 76 of an upper edge cap 78. A width of the ribbed protrusion 76 is smaller than a width of the ribbed groove 70 so that the protrusion 76 can be inserted and removed with ease from the groove 70. To attach the upper edge cap 78 to the upper edge trim 72, silicone is disposed in the ribbed slot 74. The ribbed protrusion 76 is inserted into the ribbed slot 74. The silicone flows between the ribs of the protrusion 76 and groove 70. Upon curing of the silicone, the silicone grips the ribs of the protrusion 76 and groove 70 to retain the upper edge cap 78 to the upper edge trim 72.

Figure 1E:
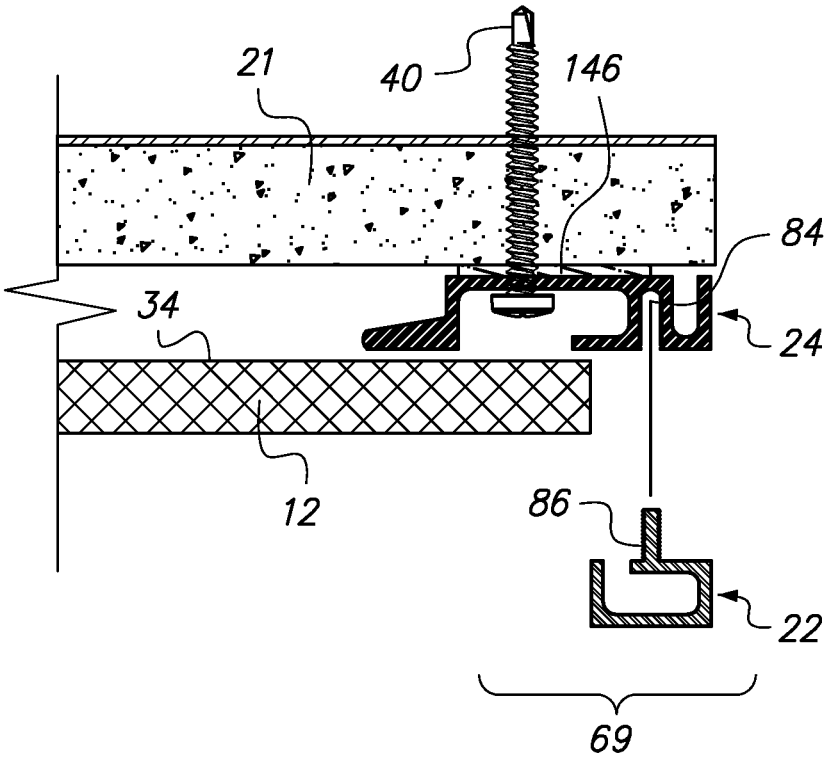
FIG. 1E is a cross-sectional view of a vertical edge of the wall panel system shown in FIG. 1.

The left most and/or right most panel 12 may have at least three different configurations. The first configuration is an outer corner 28 shown in FIG. 2. The second configuration is an inner corner 30 shown in FIG. 3. The third configuration is an edge as shown in FIG. 1E. Referring now to FIG. 1E, the right or left edge of the panel 12 does not have a clip 38 attached to the backside 34 of the panel 12. The panel 12 is not attached to the wall 21 at the left or right edge of the panel 12. The vertical edge trim 24 is attached to the wall 21 adjacent to the right edge of the right most panel 12 with one or more screws 40 or to the left edge of the left most panel 12 with one or more screws 40. The vertical edge trim 24 may have a ribbed groove 56 which receives a ribbed protrusion 86 of a vertical edge cap 22. The vertical edge cap 22 is secured to the vertical edge trim 24 by the tongue and groove 86, 84 configuration described herein, namely, the base edge cap 52 and base edge trim 32.

Figure 2:
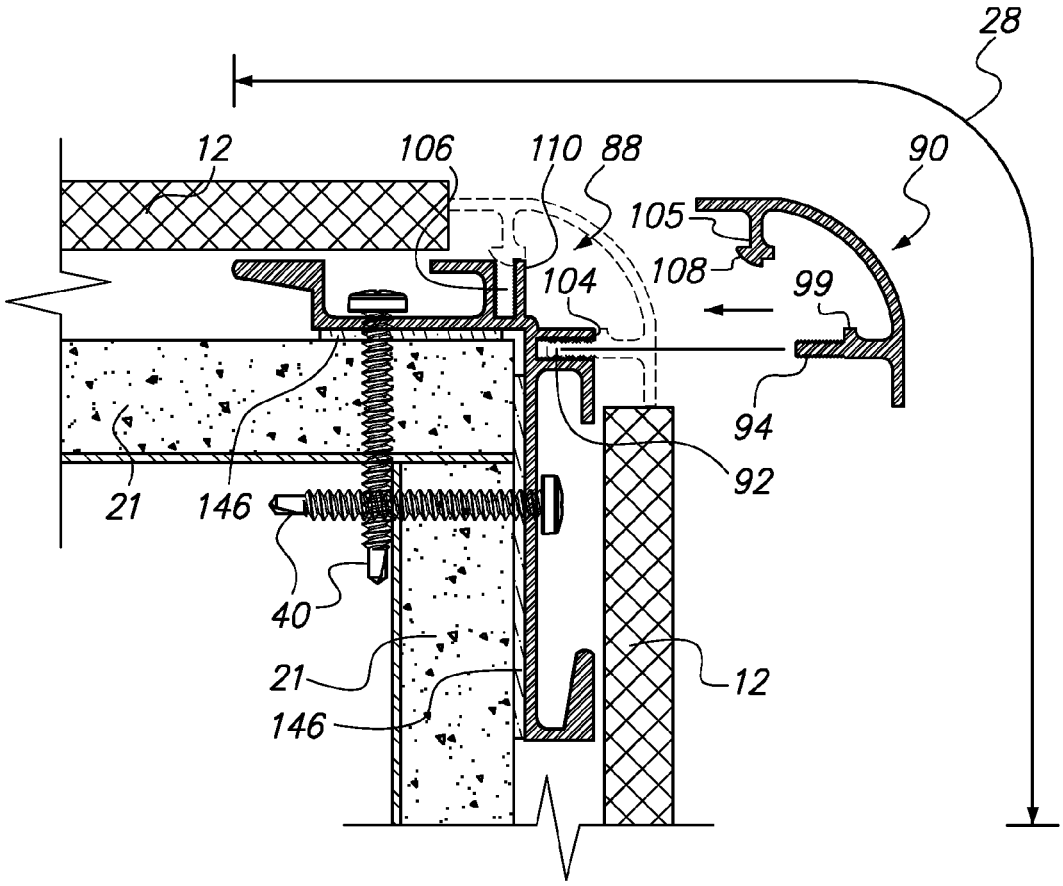
FIG. 2 is a cross-sectional view of an outside corner of the wall panel system shown in FIG. 1.

Referring now to FIG. 2, an outside corner 28 of the wall panel system 10 is shown. The outside corner 28 may have an outside corner receiver 88 which may be attached to the corner of two perpendicular adjoining walls 21 by way of screws 40. The outside corner receiver 88 may be an extruded part and may extend to the height of the panels 12 or at least to the height of one panel 12. An outside corner guard 90 is secured to the outside corner receiver 88 by way of tongue 94 and groove 92. The tongue 94 and groove 92 may have ribbed surfaces which engage each other through a silicone filler as described herein. When the tongue 94 is received into the groove 92, nub 99 of the outside corner guard 90 abuts against the end surface 104 of the outside corner receiver 88 to regulate position of the guard 90. Additionally, extension 105 of the outside corner guard 90 rides up and snaps into channel 106. The extension 105 may have caming surface 108 that spreads the outside corner guard 90 open. Once the caming surface 108 clears a first retaining wall 110 which defines a channel 106, the caming surface 108 snaps into the channel 106 to help prevent pullout of the guard 90. The panels 12 shown in FIG. 2 are held in place by the tongue and groove connection along the upper and lower edges of the panels 12 discussed previously. As you will note, the outside corner receiver 88 does not secure the panel 12 to the wall 21.

Figure 3:
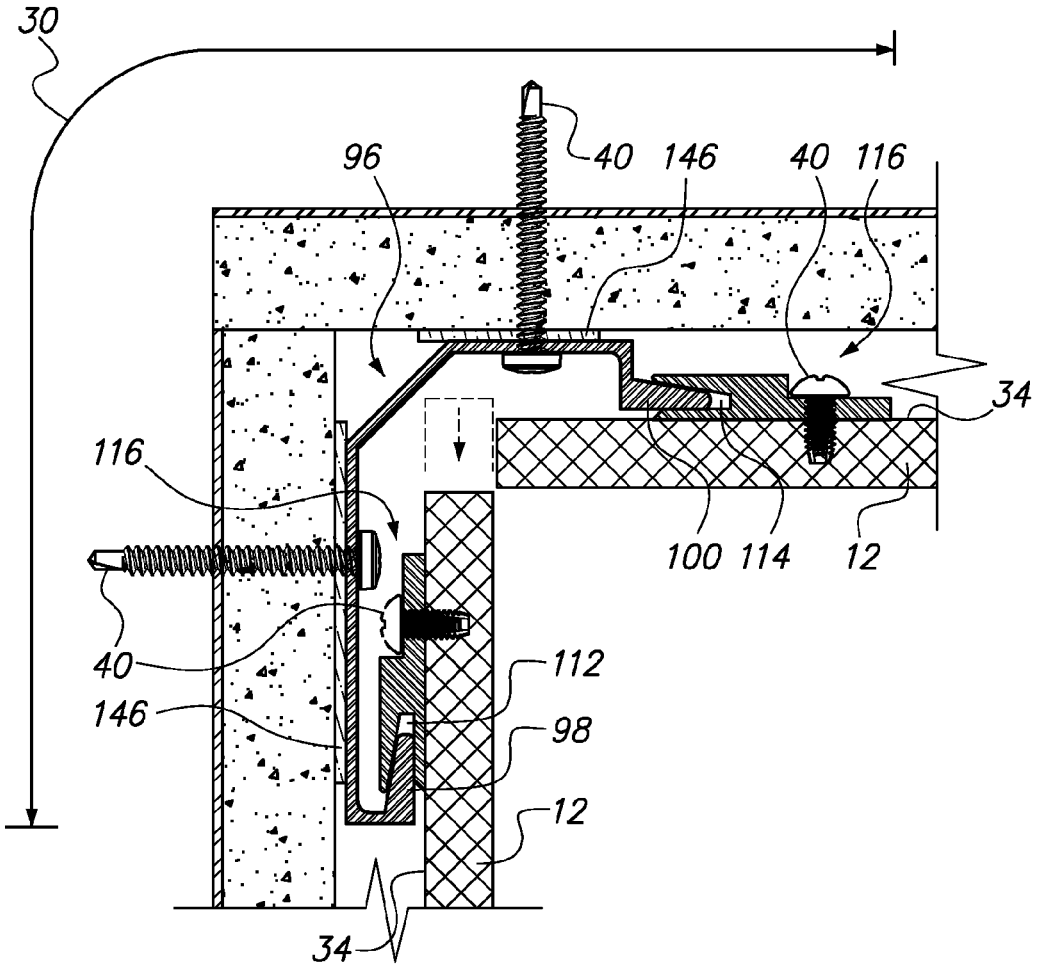
FIG. 3 is a cross-sectional view of an inside corner of the wall panel system shown in FIG. 1.

Referring now to FIG. 3, the inside corner 30 may have an inside corner joint 96 with left and right tongues 98, 100. The inside corner joint 96 is attached to the wall 21 by way of screws 40 along its length. The left and right tongues 98, 100 are oriented in the same direction. This means that one of the tongues 98, 100 such as tongue 98 points towards the corner, whereas, the other tongue 100 points away from the corner, or vice versa. The panels 12 that form the inside corner 30 are attached to the inside corner joint 96 by way of a tongue and groove connection. Since the tongues 98, 100 point in one direction, one of the panels 12 is secured to the inside corner joint 96 by traversing the panel 12 away from the corner and the other panel 12 is attached to the inside corner joint 96 by traversing the panel 12 toward the corner. In FIG. 3, the panel 12 shown in the vertical orientation is secured to the inside corner joint 96 by traversing the panel 12 away from the corner and the horizontally oriented panel 12 is secured to the inside corner joint 96 by traversing the panel 12 toward the corner. The tongues 98, 100 are received by grooves 112, 114 of vertical panel clips 116 attached vertically on the backside 34 of the panels 12 near the vertical edges. The vertical panel clips 116 may have the same cross sectional configuration as the horizontal panel clips 38 except that the vertical clips 116 are oriented in the vertical direction. The vertical panel clips 116 may also be about two to three inches long provided that the panel 12 is about 12" high or more. The vertical panel clips 116 may be attached to the backside 34 of the panel 12 with one or more screws 40.

Figure 4:
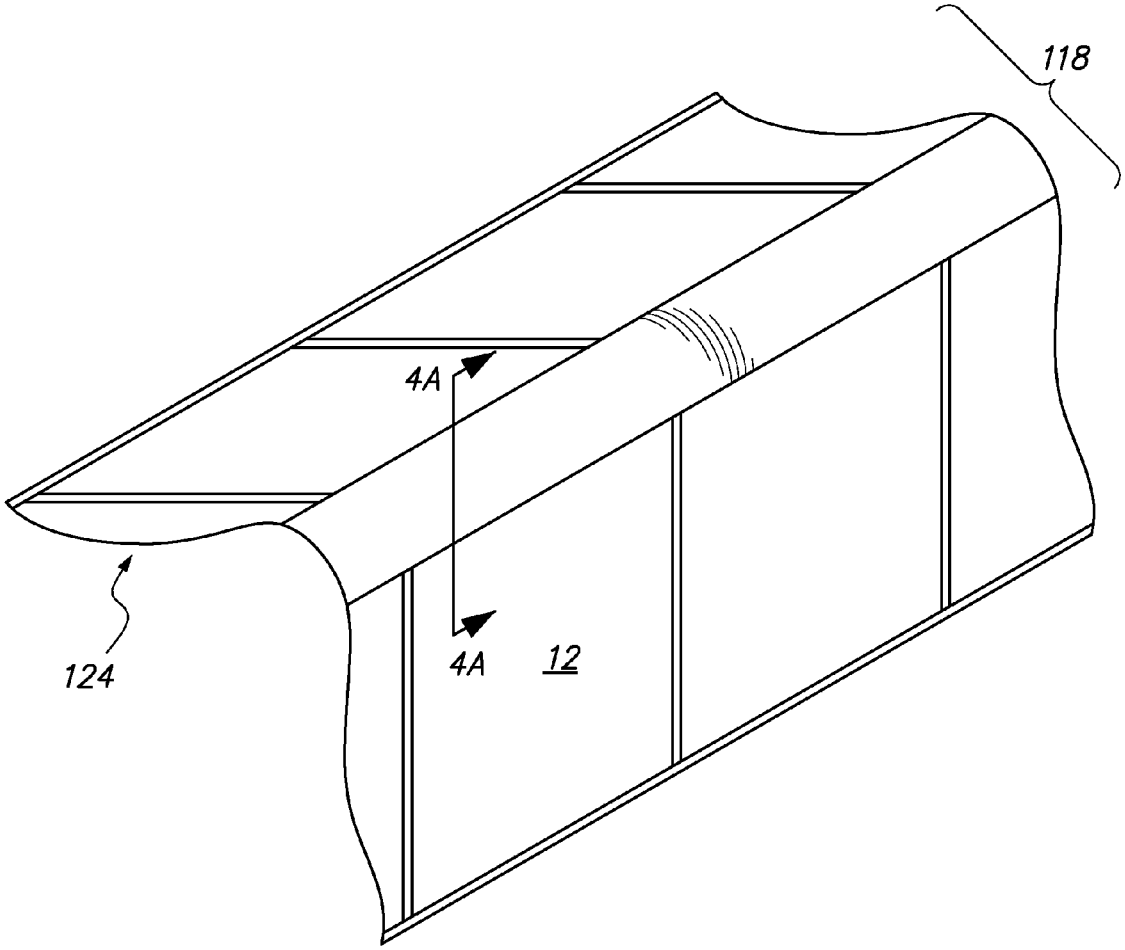
FIG. 4 is a perspective view of a horizontal corner of the wall panel system.
Figure 4A:
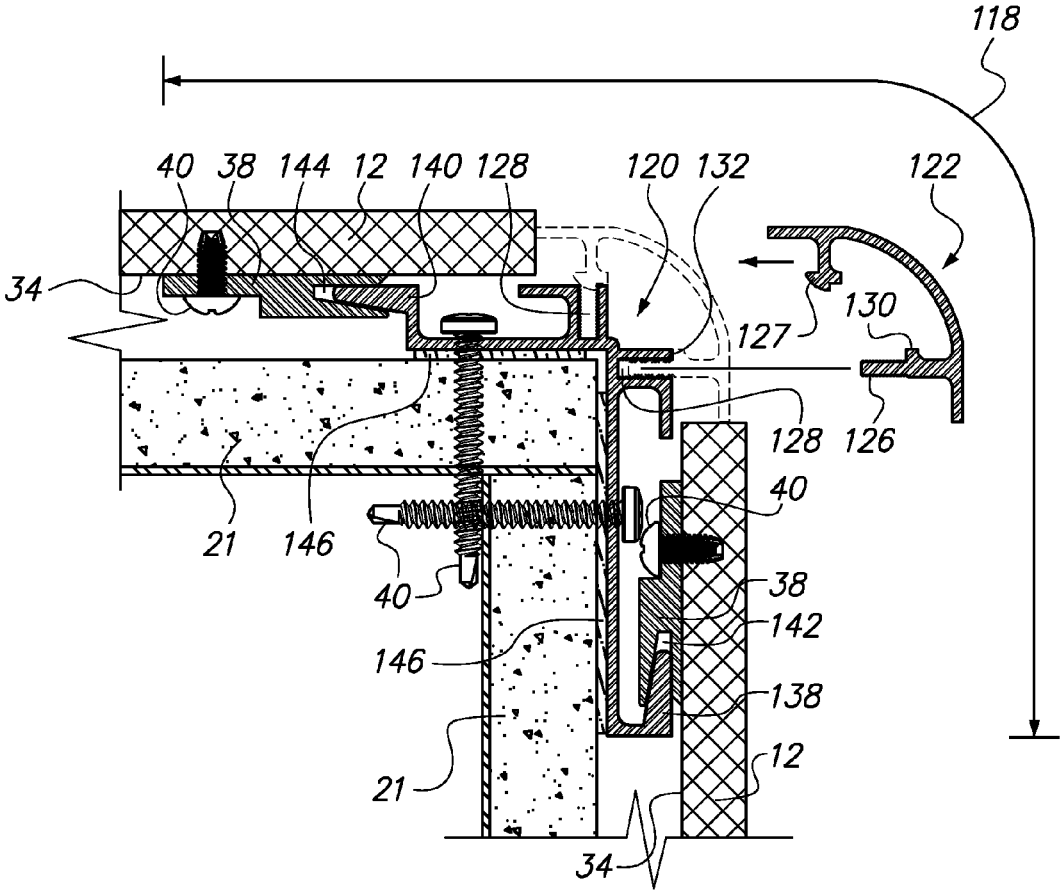
FIG. 4A is a cross-sectional view of the horizontal corner shown in FIG. 4.

Referring now to FIGS. 4 and 4A, the upper edges of the upper most row of panels 12 is shown. In certain instances, the panels 12 may be mounted to a ceiling 124 and form an upper horizontal upper corner 118 as shown in FIGS. 4 and 4A. The horizontal upper corner 118 may be attached to the wall 21 and ceiling 124 with the outside corner receiver 88 shown in FIG. 2. The horizontal upper corner 118 may include horizontal outside corner receiver 120 oriented in a horizontal direction, panel clips 38 and horizontal outside corner guard 122 which is the outside corner guard 90 oriented in a horizontal direction. The horizontal outside corner receiver 120 is attached to the wall 21 and the ceiling 124 with one or more screws 40. Panel clips 38 are attached to the backside 34 of the panels 12 with one or more screws 40. The horizontal outside corner receiver 120 has tongues 138, 140 these tongues 138, 140 are received into grooves 142, 144 of the panel clips 38. The horizontal outside corner guard 122 is attached to the horizontal outside corner receiver 120 by way of tongue and groove 126, 128 configuration in the same manner discussed above in relation to FIG. 2. For example, the horizontal outside corner guard 122 has a caming surface 127 that spreads open the horizontal outside corner guard 122 and snaps into groove 128. Nub 130 of the horizontal outside corner guard 122 regulates insertion of the tongue 126 into the groove 128 by contacting the extension 132 of the horizontal outside corner receiver 120.

Any one of the panels 12 may be removed from the wall 21 without removing the other panels 12 from the wall 21. The upper edge cap 78, horizontal joint cap 18 and the vertical edge cap 22 prevents vertical and horizontal movement of the panels 12 after installation. When one of the panels 12 is damaged, the cap 78, 18 immediately above the damaged panel 12 may be removed. The vertical edge cap 32 may also be removed from the row of panels 12 in which the damaged panel 12 is located. This allows the laterally adjacent panels 12 to be shifted to the left or/right so that the vertical splines 26 attached to the damaged panel 12 may be removed. This procedure allows the damaged panel 12 to be lifted and pulled away from the wall 21.

The base edge trim 32, horizontal joint receiver 20 and the upper edge trim 72 may be leveled to adjust the horizontal line created by each row of panels 12. The panels 12 can be shifted left to right to vertically align the panels 12 in each column of panels 12. One or more shims 146 of different thicknesses may be added behind the base edge trim 32, horizontal joint receiver 20 and the upper edge trim 72 to adjust the depth of each of the panels. One or more shims 146 of different thicknesses may be added behind the vertical edge trim 24 as needed or desired. Also, one or more shims 146 of different thicknesses may be added behind the outside corner receiver 88, inside corner joint 96 and the horizontal outside corner receiver 120 as needed or desired. It is also contemplated that the shims 146 may be disposed underneath the panel clips 38 to adjust the depth of the panels 12. The shims 146 may have a hole through which the screws 40 are inserted. The shims 146 may be located directly underneath the screw 40.

The panels 12 may be fabricated from an eco friendly material such as phenolic which is wood chips held together by resin. Other materials are also contemplated that can be provided in sheet form such as medium density fiberboard, particle board, solid wood, bamboo, plastic laminate. The panels 12 are provided in sheet form and then cut to size. The panel height and width may range from 1" to 12' high and 1" to 14' wide. The panels 12 are shown as being the same thickness. The thickness of the panel may range from about 1/16" to 1½" thick. However, each of the panels 12 may have a different thickness compared to the other panels 12 within the system. The panels 12 are also shown as being square. However, it is also contemplated that the plurality of panels 12 which make up the system 10 may be rectangular or other shapes so long as the horizontal clips 38 can be attached to the top and bottom of the panels 12 parallel to each other. Additionally, the plurality of panels 12 may be fabricated from different materials to impart a unique aesthetic look to the system 10.

The base edge trim 32, horizontal joint receiver 20, and the upper edge trim 72 all have tongues 50, 68 and 71, 134 which are oriented in the same direction. In the drawings, the tongues 50, 68 and 71, 134 are shown as being directly upwardly. These tongues 50, 68 and 71, 134 are received into grooves 48, 70 and 136 which are directed in the same direction. In the drawings, the grooves 48, 70 and 136 are shown as being directly downwardly so that the tongues 50, 68 and 71, 134 can slip into the grooves 48, 70 and 136. Preferably, the tongues 50, 68 and 71, 134 are vertically spaced apart to match the spacing between the panel clips 38 mounted to the back side of the panels 12. In this manner, the tongues 50, 68 and 71, 134 and grooves 48, 70 and 136 engage each other simultaneously when the panels 12 are mounted to the wall 21. It is also contemplated that the panel clips 38 could be formed with downwardly projecting tongues and the base edge trim 32, horizontal joint receiver 20*a* and the upper edge trim 72 may be formed with upwardly directed grooves that receives the tongues formed on the panel clips 38.

Two panel clips 38 may be attached to the upper backside 34 of each panel 12. Two panel clips 38 attached to the lower backside 34 of each panel 12. The two panel clips 38 are spread apart as wide as possible to provide stability when the tongues 50, 68 and 71, 134 and grooves 48, 70 and 136 are engaged to each other.

The mating tongues 50, 68 and 71, 134 and grooves 48, 70, and 136 described herein all may have a tapered configuration to wedge the tapered tongues 50, 68 and 71, 134 into the mating tapered grooves 48, 70, and 136 so that there is little to no play. The tapered configuration may include a flat side 148 (see FIG. 1A) and a skewed side 150.

The base edge trim 32, mating cap 52, panel clip 38, vertical spline 26, vertical joint cap 66, horizontal joint receiver 20, horizontal joint cap 18, upper edge trim 72, upper edge cap 78, vertical edge trim 24, vertical edge cap 22, outside corner receiver 88, outside corner guard 90, inside corner joint 96, horizontal outside corner receiver 120 and the horizontal outside corner guard 122 may be extruded out of aluminum or other suitable material. Other materials that are contemplated are plastic, steel, etc. These components can be extruded and cut to length as the situation dictates or as desired. These components are described as being attached to the wall 21 or the panel 12 with screws 40. It is contemplated that these components may be secured to the wall 21 or the panel 12 with one or more screws 40 along the length of the respective component.

The system has been described and shown with the base edge trim 32, base edge cap 52, horizontal joint receiver 20, horizontal joint cap 18, the upper edge trim 72 and the upper edge cap 78 as extending across the row of panels 12, while the vertical splines 26 and the vertical joint cap 66 extends along the height of one panel 12 and abuts respective base edge trim 32, base edge cap 52, horizontal joint receiver 20, horizontal joint cap 18, the upper edge trim 72 and the upper edge cap 78. However, it is also contemplated that the vertical splines 26 and the vertical joint cap 66 may extend along the height of the stacked panels 12, while the base edge trim 32, base edge cap 52, horizontal joint receiver 20, horizontal joint cap 18, the upper edge trim 72 and the upper edge cap 78 may extend across one panel 12 and abuts respective vertical spline 26 and vertical joint cap 66.

Air is allowed to flow behind the panels 12 from above and below the panels 12. As discussed herein the horizontal panel clips 38 do not extend across the entire panel 12. Rather, preferably, two short horizontal panel clips 38 are attached to the backside of the panels 12. The distance or gap between the two short horizontal panel clips 38 allows air to flow behind the panels 12 so that no moisture is trapped behind the panel and the humidity behind and in front of the panels 12 are equalized to mitigate warping and other detrimental effects.

The wall panel system 10 discussed herein may be mounted to a vertical wall or another wall which is oriented in a direction other than vertical such as skewed or horizontal (e.g., ceiling).

The above description is given by way of example, and not limitation. Given the above disclosure, one skilled in the art could devise variations that are within the scope and spirit of the invention disclosed herein, including various ways of fabricating the various components. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A wall panel system installed on a first wall or ceiling, the system comprising:

a plurality of panels arranged in a plurality of rows and columns within a common plane wherein:

each panel defining opposed upper and lower edges and a back surface, the upper edges of a lower row of panels disposed immediately adjacent to the lower edges of an upper row of panels, the upper and lower edges of adjacent upper and lower panels of the upper and lower row of panels defining horizontal gaps to permit selective removal of the panels;

each panel defining opposed left and right edges, the left edges of a right column of panels disposed immediately adjacent to the right edge of a left column of panels, the left and right edges of adjacent left and right panels of left and right columns of panels defining vertical gaps;

a plurality of clips defining either clip grooves or clip tongues, the clips attached to the back surfaces of the panels adjacent to both the upper edges and the lower edges so that the clip grooves or clip tongues are oriented in a first vertical direction generally parallel to the common plane, wherein the clips are fixed and stationary to the back surfaces of the panels, each clip extending partially across the back surface of the panel so that air is allowed to flow up and down between the clips to mitigate detrimental effects of moisture buildup;

a plurality of elongate joints attached to the first wall for securing the plurality of panels to the first wall, a first joint of the plurality of elongate joints attached on the first wall parallel and adjacent to the upper edges of the lower row of panels and the lower edges of the upper row of panels, the plurality of elongate joints having a joint tongue or a joint groove which are oriented in a second vertical direction generally parallel to the common plane which is opposite the first vertical direction for receiving either of the clip grooves or the clip tongues, respectively, the plurality of elongate joints sufficiently spaced away from the back surface of the panels to permit sufficient air flow between adjacent upper and lower panels to mitigate detrimental effects of moisture buildup;

a plurality of horizontal trims disposed within the horizontal gaps between upper and lower edges of adjacent panels so that the horizontal trims are flush with the upper and lower edges of adjacent panels to mitigate movement of the panels for securing the panels in place when the horizontal trims are disposed within the gaps and the horizontal trims are flush with the upper and lower edges of adjacent panels, the horizontal trims being removably attachable to the plurality of elongate joints with a tongue and groove connection therebetween;

a plurality of vertical splines disposed between adjacent left and right panels, the vertical splines attached to adjacent left and right panels with a tongue and groove connection, the vertical splines spaced away from the first wall to permit sufficient airflow between left and right panels to mitigate detrimental effects of moisture buildup;

wherein any one of the panels from the lower row of panels is removable from the first wall independent of the upper row of panels and panels to the left and right of the panel to be removed by removing only a trim of the plurality of trims which is disposed above a panel of the plurality of panels to be removed to provide for replacement of a damaged panel;

wherein air is allowed to flow up and down across the plurality of elongate joints through spaces defined by the plurality of elongate joints and the back surfaces of the panels.

2. The system of claim 1 wherein the common plane is vertical.

3. The system of claim 1 wherein the plurality of clips define clip grooves so that the clip grooves are oriented in a downward direction when the clip grooves are attached to the back surfaces of the panels, and the plurality of elongate joints have joint tongues which are oriented in a upward direction, wherein the grooves are defined by inner and outer flanges wherein the inner flanges contact the back surfaces of the panels and regulate a minimum distance between distal edges of the joint tongues of the plurality of elongate joints and the back surfaces of the panels to permit sufficient air flow between upper and lower panels to equalize moisture.

4. The system of claim 1 wherein the left and right edges together with the upper and lower edges define an outer periphery of the panel.

5. The system of claim 4 wherein the left and right edges have grooves, the third groove of one panel being aligned to a fourth groove of an adjacent panel, the system further comprising the vertical spline received into the third groove of the one panel and the fourth groove of the adjacent panel.

6. The system of claim 5 further comprising a spline cap attachable to the vertical spline.

7. The system of claim 1 further comprising an upper edge cap in contact with the upper edge of the upper most panel and attached to an elongate joint of the plurality of elongate joints disposed adjacent to the upper edge of the upper most panel.

8. The system of claim 1 further comprising a horizontal joint cap in contact with the upper edge of the panel and attached to an elongate joint of the plurality of elongate joints disposed adjacent to the upper edge of the panel.

9. The system of claim 1 wherein the clip tongue or the joint tongue has a tapered cross sectional configuration.

10. The system of claim 1 further comprising:

a second wall connected to the first wall or the ceiling wherein the second wall and the first wall defines a vertical corner and the second wall and the ceiling defines a horizontal corner;

a corner receiver attached to the vertical corner or the horizontal corner.

11. The system of claim 10 wherein the vertical corner is an inside corner or an outside corner.

12. The system of claim 10 further comprising a corner guard attached to the corner receiver with a tongue and groove connection.

13. A method of providing airflow behind a plurality of panels between upper and lower panels and left and right panels while allowing for ease of changing out a lower panel secured in place beneath an upper panel which are vertically arranged and mounted to a wall, the method comprising the steps of:

providing the lower and upper panels mounted to the wall wherein the lower and upper panels are arranged vertically as a column, the lower and upper panels defining a horizontal gap wherein the horizontal gap has a horizontal cap disposed within the horizontal gap between the lower and upper panels so as to be flush with the upper edge of the lower panel and the lower edge of the upper panel to prevent vertical movement of the lower panel disposed beneath such horizontal cap and the upper panel, back surfaces of the panels gapped away from horizontal joints with horizontal clips that do not extend across an entire back surface of any one of the panels for permitting airflow between upper and lower panels to mitigate mold, left and right panels having a gap therebetween filled with a vertical spline spaced away from the wall for permitting airflow between left and right panels to mitigate mold;

removing only the horizontal cap from between the lower and upper panels by disengaging a tongue and groove connection between the horizontal cap and an upper horizontal joint of the horizontal joints attached to the wall;

traversing the lower panel upward to release a tongue and groove connection between an upper clip attached to an upper portion of the lower panel and the upper horizontal joint attached to the wall, and a lower clip attached to a lower portion of the lower panel and a lower horizontal joint of the horizontal joints attached to the wall;

pulling out the lower panel.

14. The method of claim 13 further comprising the steps of:

removing a vertical edge cap disposed on a lateral side of the lower panel to allow lateral movement of the lower panel.

15. The method of claim 14 further comprising the steps of:

inserting a new panel in the position of the lower panel;

reinserting the vertical edge cap;

reinserting the horizontal cap above the new panel.

* * * * *